US006702637B2

(12) United States Patent
Lee et al.

(10) Patent No.: US 6,702,637 B2
(45) Date of Patent: Mar. 9, 2004

(54) METHOD OF FORMING A SMALL GAP AND ITS APPLICATION TO THE FABRICATION OF A LATERAL FED

(75) Inventors: Choon-Sup Lee, Taegu (KR); Jae-Duk Lee, Suwon-shi (KR); Chul-Hi Han, Taejon (KR)

(73) Assignee: Korea Advanced Institute for Science and Technology (KR)

( * ) Notice: Subject to any disclaimer, the term of this patent is extended or adjusted under 35 U.S.C. 154(b) by 168 days.

(21) Appl. No.: 10/048,148

(22) Filed: Jan. 25, 2002

(65) Prior Publication Data

US 2003/0104752 A1 Jun. 5, 2003

Related U.S. Application Data

(63) Continuation of application No. 10/048,148, filed as application No. PCT/KR01/00874 on May 25, 2001.

(51) Int. Cl.[7] ..... H01J 9/12
(52) U.S. Cl. ..... 445/49
(58) Field of Search ..... 445/24, 49, 50; 216/38, 52

(56) References Cited

U.S. PATENT DOCUMENTS 4,923,421 A 5/1990 Brodie et al. ..... 445/24
5,262,000 A * 11/1993 Welbourn et al. ..... 216/2
5,445,550 A 8/1995 Xie et al. ..... 445/24
5,604,399 A * 2/1997 Mandelman et al. ..... 313/512
5,651,712 A * 7/1997 Potter ..... 445/24
6,015,326 A 1/2000 Potter ..... 445/52
6,233,125 B1 * 5/2001 Knapp et al. ..... 360/317

FOREIGN PATENT DOCUMENTS

JP 4212236 8/1992

* cited by examiner

*Primary Examiner*—Kenneth J. Ramsey
(74) *Attorney, Agent, or Firm*—Marger Johnson & McCollom, P.C.

(57) ABSTRACT

The present invention relates to a method of forming a small gap using CMP and a method for manufacturing a lateral FED. In the present invention, a small gap is determined by the thickness of an oxide film, and so uniform small gaps of about 100 Å that have been impossible to attain with the art of prior lithography can be formed with repeatability. Prior lateral field emission devices have the problem of repeatability in forming a gap for field emission because they are fabricated by means of a thermal stress method or an electrical stress method. But if the method of forming a small gap according to the present invention is used to fabricate a lateral FED, a FED can be made that has low voltage drive and high current drive characteristics and uniform field emission characteristics.

14 Claims, 4 Drawing Sheets

METHOD OF FORMING A SMALL GAP AND ITS APPLICATION TO THE FABRICATION OF A LATERAL FED

TECHNICAL FIELD

The present invention relates to a method of forming a small gap using CMP (chemical mechanical polishing) and a method of manufacturing a lateral FED (field emission device) using the same.

BACKGROUND ART

In a device such as a sensor or a driver, generally, the greater electrostatic force is, the greater output signal is obtained. In the case of a FED, as electrostatic force becomes greater, its operating voltage is lowered, which enables its application to portable electronic appliances.

To increase the electrostatic force between electrodes, (1) the applied voltage should be increased; (2) area of the electrode should be increased; or (3) distance between the electrodes should be decreased.

The first method is not advisable because it needs the application of high voltage. And the electrostatic force is linearly proportional to the area of an electrode whereas it is inversely proportional to the square of distance between electrodes. Accordingly, the third method is the most effective one to obtain great electrostatic force.

To increase the electrostatic force, traditional MEMS (MicroElectroMechanical System) has used the second method (forming an electrode structure having a high aspect ratio) rather than the third method. It was not till recent days that the researches are concentrated on the third method.

As an example of prior art for reducing the distance between electrodes may be cited a process where comb structures of coarse teeth and comb structure of fine teeth are formed on a poly-silicon layer by means of thermal oxidation process, and then the fine teeth are located between the coarse teeth. However, this method requires additional process of locating the coarse teeth between the fine teeth, so the process itself is very difficult.

Another example is to form a comb-drive of a somewhat wide spacing, using poly-silicon, and then to deposit a poly-silicon layer thereon to decrease the wide spacing. However, this method exhibits low repeatability because only when the poly-silicon is evenly deposited on the underlying structure, the spacing between electrodes can become regular, and uniform electrostatic force can be obtained.

One example of application areas where a small gap is required is FED. FED is widely used in diverse areas such as flat panel displays, active elements of an integrated circuit, electron guns, microwave tubes, and sensors of various kinds.

The FED should have low operating voltage and uniform field emission characteristics. In the case of a lateral FED, to lower its operating voltage, it is desirable to reduce the spacing between electrodes. For this purpose, prior arts have used electrical stress or thermal stress. However, these methods have difficulty in making the spacing uniform though they can narrow spacing between electrodes. Therefore it is difficult to obtain uniform field emission characteristics by means of these methods.

Prior methods to fabricate a lateral FED may be divided as follows: First, to make a small gap between electrodes by means of electron beam lithography. A small gap may be formed with this method, which, however, has a defect that it entails too much process cost. Second, to apply heat of high temperature to poly-silicon, and utilize a small gap that is formed when poly-silicon is cut due to thermal stress. This method has a defect that a manufacturing process of high temperature is required and the repeatability is relatively low. Third, to pattern a Pd0 thin film, and utilize a small gap formed by electric stress. This method also has a defect that the repeatability is relatively low because it uses stress.

As stated above, although it is important to make a very small and uniform gap between electrodes, researches on it have not been satisfactory up to now.

DISCLOSURE OF THE INVENTION

Accordingly, it is an object of the present invention to provide a method for forming a small gap that can solve the aforementioned traditional problems through employing CMP, which is an entirely new method.

Another object of the present invention is to provide a method for fabricating a lateral FED having low operating voltage and uniform field emission characteristics through forming a probe with a sharp point, using the method of forming a small gap provided by the above object.

BEST MODE FOR CARRYING OUT THE INVENTION

Figure 1A:
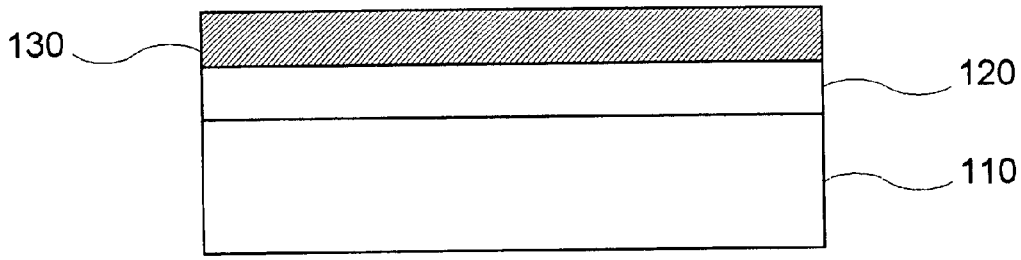
FIGS. 1A to 1E are cross-sectional diagrams for illustrating the method of forming a small gap according to the embodiment of the present invention.

According to one embodiment of the present invention to meet the above purposes, the present invention provides a method for forming a small gap comprising the steps of:

forming a first sacrificial layer on a substrate;

forming of a first silicon film pattern on the first sacrificial layer;

forming a second sacrificial layer on the top and side of the first silicon film pattern;

forming a second silicon film overlying the resulting product where the second sacrificial layer is formed; and forming a second silicon film pattern through carrying out CMP on the second silicon film so that the second sacrificial layer located on the top of the first silicon film pattern may be exposed; and forming a small gap between the first silicon film pattern and the second silicon film pattern through removing the second sacrificial layer.

Here, it is desirable that the first sacrificial layer and the second sacrificial layer should be silicon oxide films, and it is more desirable that the second sacrificial layer should be formed by thermal oxidation. And it is desirable that the second sacrificial layer should be removed by wet etching. In addition, it is desirable that slurry that reacts with silicon but does not react with the second sacrificial layer should be used for the CMP.

The method for forming a small gap according to the present invention may sequentially comprise a step of removing the second sacrificial layer followed by an additional step of removing the first sacrificial layer located at the lower part of the small gap, using the same method as that of removing the second sacrificial layer.

According to an embodiment of the present invention to meet another object, the present invention provides for a method of fabricating a lateral field emission device (FED) comprising the steps of:

forming a first sacrificial layer on a substrate;

forming on the first sacrificial layer a first probe layer comprising silicon in the shape of Mesa with a gently slanting side and into which a dopant has been injected;

forming a second sacrificial layer on the top and side of the first probe layer;

forming a doped silicon film overlying the resulting product where the second sacrificial layer has been formed;

forming a second probe layer through chemically mechanically polishing the silicon film so that the second sacrificial layer located on the top of the first probe layer maybe exposed;

making a probe gap between the first probe layer and the second probe layer by removing the second sacrificial layer;

forming a first sacrificial layer pattern through removing the first sacrificial layer located on the lower part of the side of the first probe layer; and forming metal interconnections on the first probe layer and the second probe layer, respectively.

Here, it is desirable that the first sacrificial layer and the second sacrificial layer should be silicon oxide films, and it is more desirable that the second sacrificial layer should be formed by thermal oxidation. And it is desirable that the step of forming the probe gap and the step of forming the first sacrificial layer should be carried out sequentially by wet etching using the same etching solution. In addition, it is desirable that slurry that reacts with silicon but does not react with the second sacrificial layer should be used for the CMP.

The preferred embodiments of the present invention will be described hereinafter with reference to the attached drawings. Similar reference numerals refer to similar elements having similar functions, and no repetitive descriptions of those elements will be set forth.

FIGS. 1A to 1E are cross-sectional diagrams for illustrating the method of forming a small gap according to the first embodiment of the present invention.

Figure 1B:
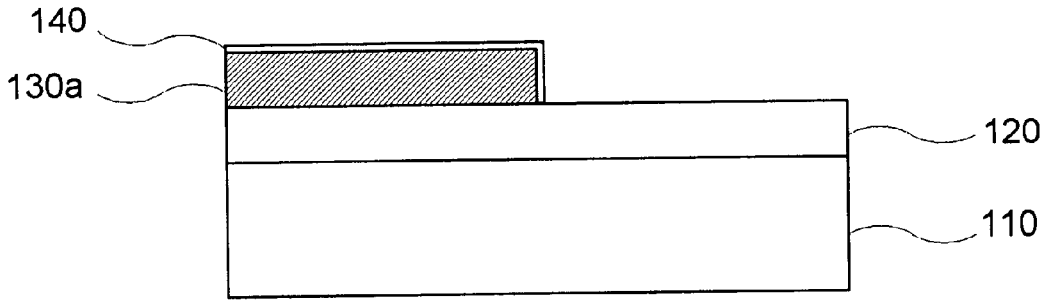

FIGS. 1A and 1B are cross-sectional diagrams for illustrating the steps of forming a first silicon film pattern 130*a* and a second silicon oxide film 140. First, a first silicon oxide film 120 is formed on a silicon substrate 110 by CVD (chemical vapor deposition) or thermal oxidation, and then a poly-crystalline or amorphous first silicon film 130 is formed on the first silicon oxide film 120. Then, anisotropic etching of the first silicon film 130 is carried out to expose the first silicon oxide film 120 and form the first silicon film pattern 130*a*. Here, the etched end of the first silicon film pattern 130*a* comes to be perpendicular to the underlying structure.

Thereafter, a second silicon oxide film 140 is formed by thermally oxidizing the resulting product where the first silicon film pattern 130*a* has been formed. Here, the second silicon oxide film 140 is formed on the first silicon film pattern 130*a* more thickly than the first silicon oxide film 120 because the growth rate of the second silicon oxide film 140 is very slow on the first silicon oxide film 120. FIG. 1B omits the illustration of the second silicon oxide film 140 formed on the first silicon oxide film 120.

On the other hand, the second silicon oxide film 140 may be formed by means of CVD. In this case, the deposition rate of the second silicon oxide film 140 shows not much difference either on the first silicon oxide film 120 or on the first silicon film pattern 130*a*. Therefore the second silicon oxide film 140 of similar thickness will be formed across the substrate.

Figure 1C:
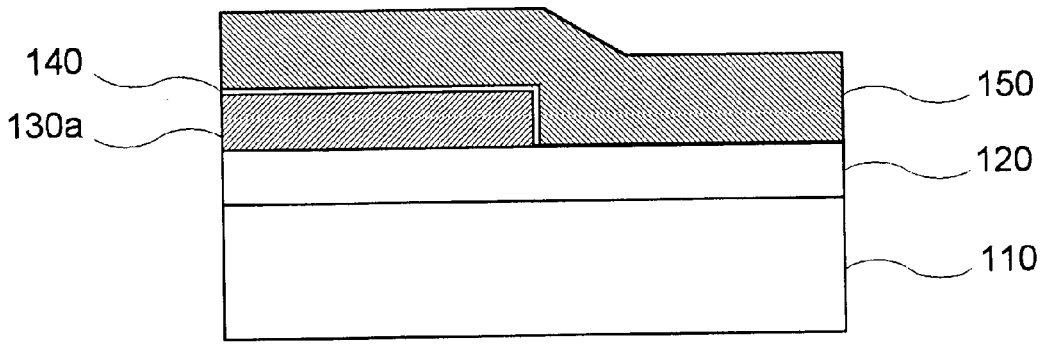
Figure 1D:
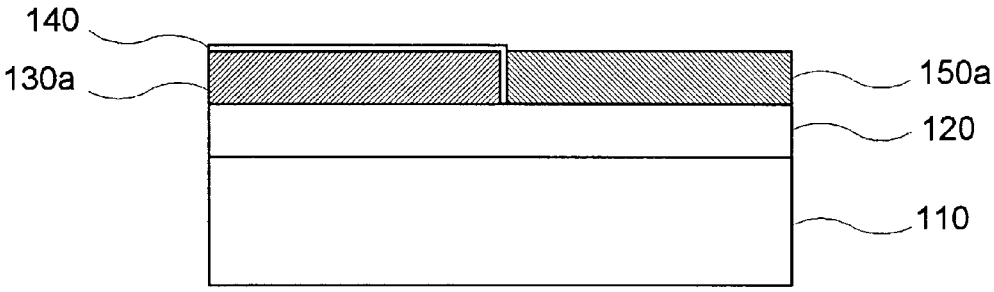

FIGS. 1C and 1D are cross-sectional diagrams for illustrating the steps of forming a second silicon film pattern 150*a*. First, a poly-crystalline or amorphous second silicon film 150 is formed across the resulting product where the second silicon film 140 has been formed. Then the second silicon film 150 is chemically mechanically polished so that the second silicon oxide film 140 may be exposed, whereby the second silicon film pattern 150*a* is formed.

In this case, slurry that chemically reacts with silicon but does not react with the oxide film must be used for the CMP, for the second silicon oxide film 140 must not be removed during the progress of the CMP. It is desirable that the CMP should be carried out carefully to prevent the surface of the second silicon film pattern 150*a* from being hollowed out by the dishing effect and so being located below the surface of the second silicon oxide film 140.

Figure 1E:
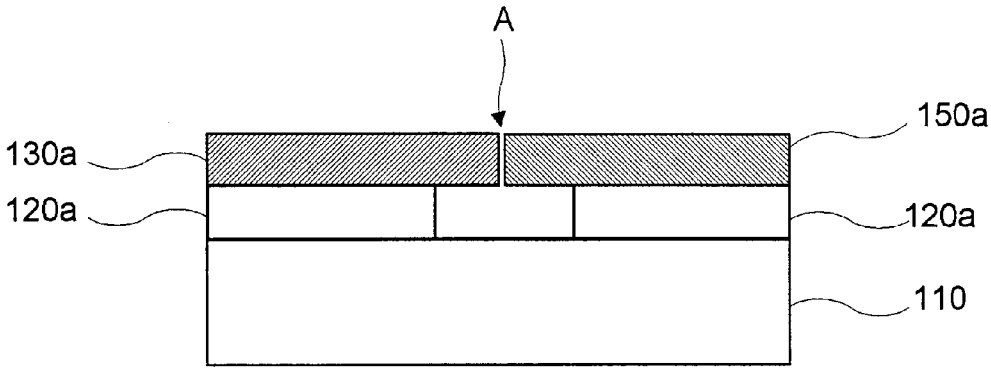

FIG. 1E is a cross-sectional diagram for illustrating the step of forming the small gap A. To put it concretely, the second silicon oxide film 140 is selectively removed through carrying out wet etching on the resulting product where the second silicon film pattern 150*a* has been formed, using an etching solution that selectively etches a silicon oxide alone against silicon. Accordingly, a small gap A will be formed at an area where was located the second silicon oxide film 140 that was formed on the etched end of the first silicon film pattern 130*a*. At this time, the first silicon oxide film pattern 120*a* is also formed, as the first silicon oxide film 120 that is located under the small gap A is also isotropically removed by the etching solution, because the first silicon oxide film 120 is composed of the same material as that of the second silicon oxide film 140.

According to the above-mentioned method of forming a small gap on the basis of the present invention, a gap between the first silicon film pattern 130*a* and the second silicon film pattern 150*a* that are opposite to each other is determined by the thickness of the first silicon oxide film 140. The gap between the first silicon film pattern 130*a* and the second silicon film pattern 150*a* can be made to be very thin because the first silicon oxide film 140 can be formed very thinly by the unit of Å through regulating the process of oxide film growth or deposition. Furthermore, a very uniform small gap can be made if the part of the second silicon oxide film 140 that is formed on the etched end of the first silicon film pattern 130*a* has a uniform thickness.

In case that the first silicon film pattern 130*a* and the second silicon film pattern 150*a* are turned into electrodes through the injection of a dopant into them, and the structure shown in FIG. 1E is applied to a sensor or a driver, a great output signal can be obtained because electrostatic force between the electrodes is very great. Also, in case that it is applied to a lateral FED, an operating voltage will be lowered. A lateral FED with such a low operating voltage may have various applications such as a 2-axis accelerometer or a sensor requiring high sensitivity.

FIGS. 2A to 2G are cross-sectional diagrams for illustrating a process for fabricating a lateral FED, with the method of forming a small gap according to the present invention.

Figure 2A:
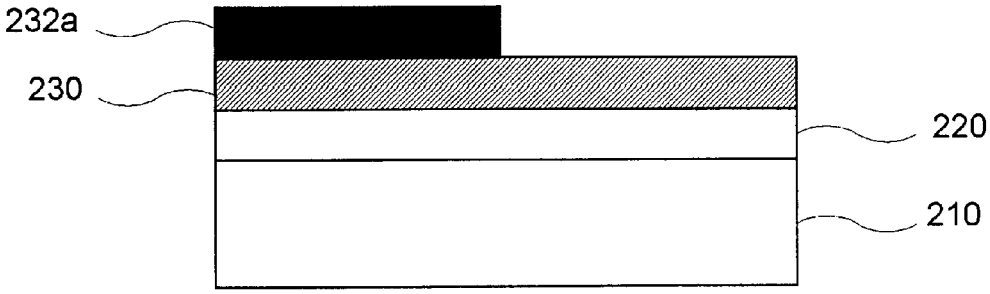
FIGS. 2A to 2G are cross-sectional diagrams for illustrating the method of fabricating a lateral FED according to the embodiment of the present invention.
Figure 2B:
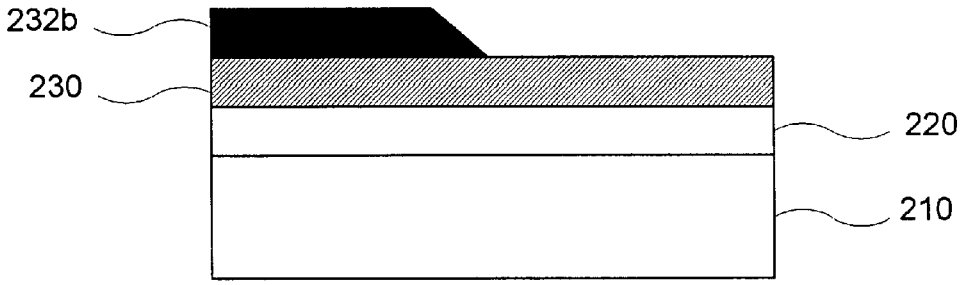
Figure 2C:
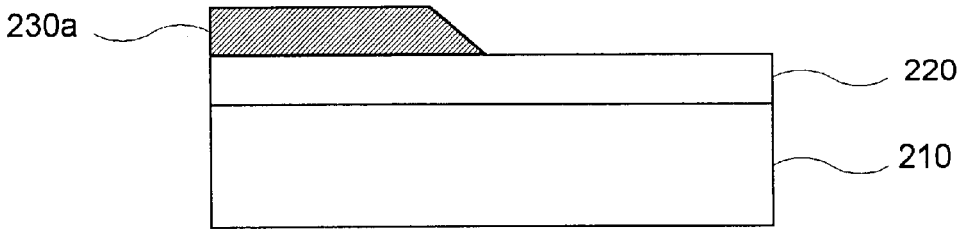

FIGS. 2A and 2C are cross-sectional diagrams for illustrating the steps of forming a first probe layer 230*a*. First, a first silicon oxide film 220 and a first silicon film 230 are sequentially formed on a silicon substrate 210, and then a dopant, e.g. phosphorus (P) is injected into the first silicon film 230 so that the first silicon film 230 may have conductivity.

Next, its resulting product is heat-treated, after the photoresist film pattern 232*a* has been formed on the first silicon film 230, so that a photoresist film pattern 232*a* may reflow, whereby is formed a Mesa-type photoresist film pattern 232*b* with gentle side inclination, i.e. whose lower part is more spread than its upper part.

Subsequently, the first silicon film 230 is anisotropically etched, with the Mesa-type photoresist film pattern 232*b* as an etching mask, so that the first silicon oxide film 220 may be exposed to form the first probe layer 230*a*. Thereafter the Mesa-type photoresist film pattern 232*b* is removed. Here, the first probe layer 230*a* will have the same shape as the side of the Mesa-type photoresist film pattern 232*b,* i.e. a shape of the tapering bottom.

Figure 2D:
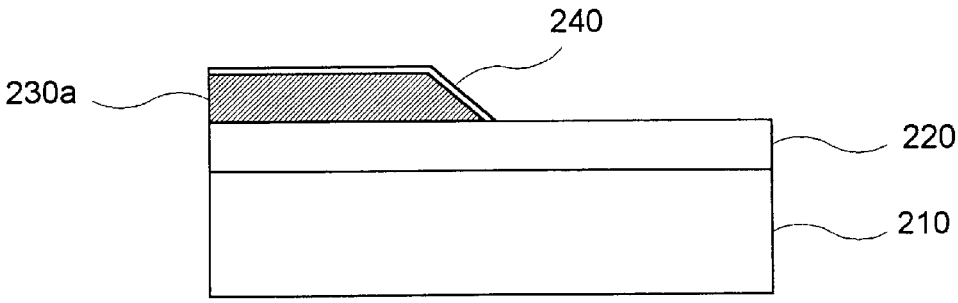
Figure 2E:
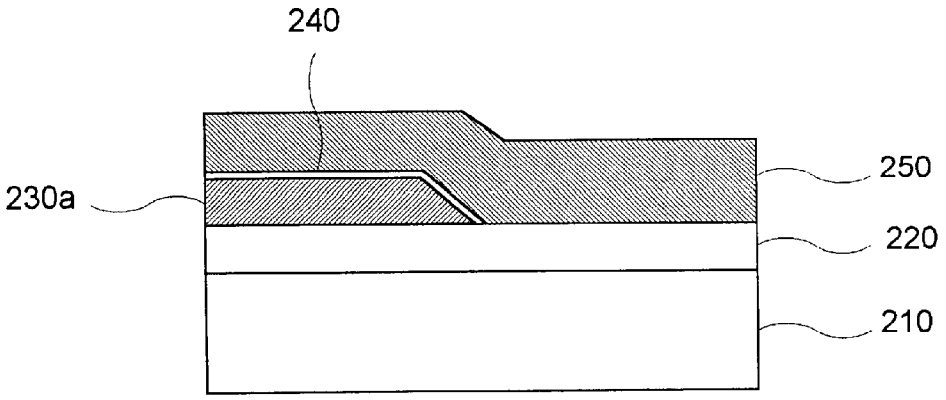
Figure 2F:
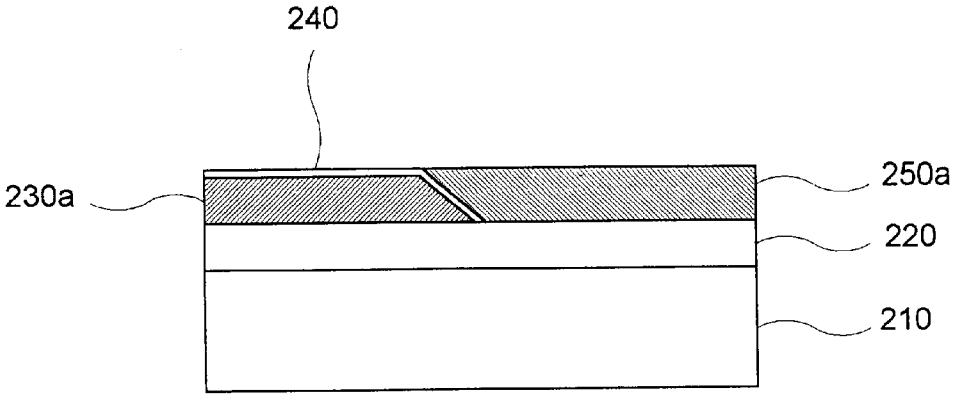

FIGS. 2D and 2F are cross-sectional diagrams for illustrating the steps of forming a second silicon oxide film 240 and a second probe layer 250*a*. First, the second silicon oxide film 240 is formed by thermal oxidation overlying the resulting product where the first probe layer 230*a* has been formed. As in FIG. 1B, the illustration of the second silicon oxide film 240 formed on the first silicon oxide film 220 is omitted. Next, phosphorus (P) is injected into a second silicon film 250, as in the case of the first silicon film 230, after the poly-crystalline or amorphous second silicon film 250 is formed overlying the resulting product where the second silicon oxide film 240 has been formed. Then the second probe layer 250*a* is formed by CMP as in FIG. 1D.

Figure 2G:
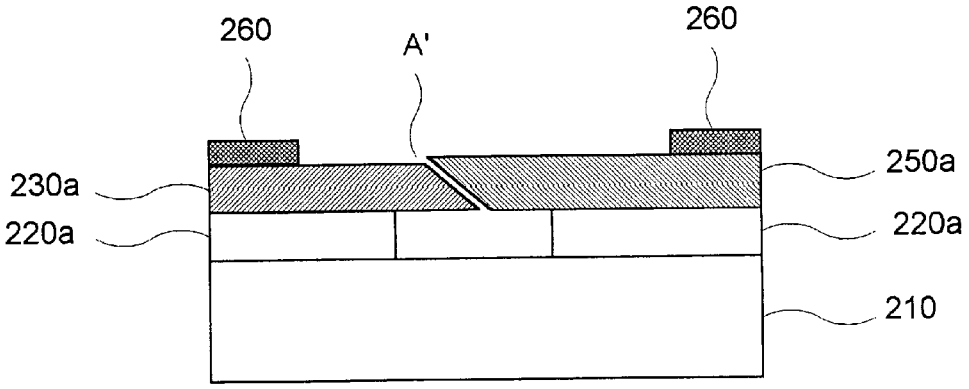

FIG. 2G is a cross-sectional diagram for illustrating the steps of forming a probe gap A' and metal interconnections 260. First, the probe gap A' and the first silicon oxide film pattern 220*a* are formed by wet etching as in FIG. 1E. The probe gap A' of here has a slanted shape unlike the small gap A of FIG. 1E that is formed perpendicularly. Next, the metal interconnections 260 are formed on the first probe layer 230*a* and the second probe layer 250*a,* respectively.

According to the method for fabricating a lateral FED of the present invention, a probe gap A' that is uniform as well as small can be formed, as mentioned above in the part regarding the method of forming a small gap. Furthermore, the tapering of the first probe layer 230*a* and the second probe layer 250*a* which face each other causes field concentration to occur and increases the field enhancement factor β. Accordingly, a lateral FED fabricated according to the present invention will have still lower operating voltage.

INDUSTRIAL APPLICABILITY

According to the method for forming a small gap of the present invention, uniform small gaps of about 100 Å that has been impossible to attain with the art of prior lithography can be reproducibly made through employing CMP. Such a method of forming a small gap can be used to fabricate a sensor or driver that has a great output signal, and also can be applied to the fabrication of comb-drive.

And with the method of the present invention for fabricating a lateral FED, a FED with low voltage drive & high current drive characteristics and uniform field emission characteristics can be made. A lateral FED fabricated according to the present invention can be applied to FPD (flat panel display) on which a lot of researches are now being conducted for its commercialization. Especially, it is advantageous to a display with wide area because its fabrication process is simple and is carried out at low temperature.

The scope of the present invention is not limited to the above-illustrated embodiments alone. It is obvious that a person who has ordinary knowledge in the appropriate field can carry out various modifications within the technical idea of the present invention.

What is claimed is:

1. A method of forming a small gap comprising the steps of:

forming a first sacrificial layer on a substrate;

forming of a first silicon film pattern on the first sacrificial layer;

forming a second sacrificial layer on the top and side of the first silicon film pattern;

forming a second silicon film overlying the resulting product where the second sacrificial layer is formed; and forming a second silicon film pattern through carrying out CMP on the second silicon film so that the second sacrificial layer located on the top of the first silicon film pattern may be exposed; and forming a small gap between the first silicon film pattern and the second silicon film pattern through removing the second sacrificial layer.

2. The method of forming a small gap as claimed in claim 1, wherein the first sacrificial layer is a silicon oxide film.

3. The method of forming a small gap as claimed in claim 1, wherein the second sacrificial layer is a silicon oxide film.

4. The method of forming a small gap as claimed in claim 3, wherein the second sacrificial layer is formed by thermal oxidation.

5. The method of forming a small gap as claimed in claim 1, wherein slurry that chemically reacts with silicon but does not react with the second sacrificial layer is used for the CMP.

6. The method of forming a small gap as claimed in claim 1, comprising sequentially, after the step of removing the second sacrificial layer, the additional step of removing the first sacrificial layer located at the lower part of the small gap, using the same method as that of removing the second sacrificial layer.

7. The method of forming a small gap as claimed in claim 1, wherein the second sacrificial layer is removed by wet etching.

8. The method of forming a small gap as claimed in claim 6, wherein the second sacrificial layer is removed by wet etching.

9. A method of fabricating a lateral FED comprising the steps of:

forming a first sacrificial layer on a substrate;

forming on the first sacrificial layer a first probe layer comprising silicon in the shape of Mesa with a gently slanting side and into which a dopant has been injected;

forming a second sacrificial layer on the top and side of the first probe layer;

forming a doped silicon film overlying the resulting product where the second sacrificial layer has been formed;

forming a second probe layer through chemically mechanically polishing the silicon film so that the second sacrificial layer located on the top of the first probe layer may be exposed;

making a probe gap between the first probe layer and the second probe layer by removing the second sacrificial layer;

forming a first sacrificial layer pattern through removing the first sacrificial layer located on the lower part of the side of the first probe layer; and forming metal interconnections on the first probe layer and the second probe layer, respectively.

10. The method of fabricating a lateral FED as claimed in claim 9, wherein the first sacrificial layer and the second sacrificial layer are silicon oxide films.

11. The method of fabricating a lateral FED as claimed in claim 10, wherein the second sacrificial layer is formed by thermal oxidation.

12. The method of fabricating a lateral FED as claimed in claim 11, wherein the step of forming the probe gap and the step of forming the first sacrificial layer pattern are carried out sequentially by means of wet etching where the same wet etching solution is used.

13. The method of fabricating a lateral FED as claimed in claim 9, wherein slurry that chemically reacts with silicon but does not react with the second sacrificial layer is used for the CMP.

14. The method of fabricating a lateral FED as claimed in claim 9, wherein the step of forming the first probe layer comprises the steps of:

forming on the first sacrificial layer a doped silicon film;

forming a photoresist film pattern on the silicon film on the first sacrificial layer;

forming a Mesa-type photoresist film pattern having a gentle side slope through thermal treatment on the resulting product with the photoresist film pattern so that the photoresist film pattern may reflow; and anisotropically etching the silicon film on the first sacrificial layer, with the Mesa-type photoresist etching film pattern as an etching mask, so that the first sacrificial layer may be exposed.

* * * * *

UNITED STATES PATENT AND TRADEMARK OFFICE

CERTIFICATE OF CORRECTION

PATENT NO. : 6,702,637 B2
APPLICATION NO. : 10/048148
DATED : March 9, 2004
INVENTOR(S) : Lee et al.

It is certified that error appears in the above-identified patent and that said Letters Patent is hereby corrected as shown below:

Title Page Sheet, Item (30) Foreign Application Priority Data, should read

--May 26, 2000 (KR) …….. 2000-28569

July 27, 2000 (KR)…… 2000-43255--.

Signed and Sealed this

Twenty-sixth Day of February, 2008

JON W. DUDAS
*Director of the United States Patent and Trademark Office*